US006787720B1

(12) United States Patent
Wong

(10) Patent No.: US 6,787,720 B1
(45) Date of Patent: Sep. 7, 2004

(54) GETTERING AGENT AND METHOD TO PREVENT CORROSION IN A FLUID SWITCH

(75) Inventor: Marvin Glenn Wong, Woodland Park, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 43 days.

(21) Appl. No.: 10/632,022

(22) Filed: Jul. 31, 2003

(51) Int. Cl.[7] ..... H01H 29/00
(52) U.S. Cl. ..... 200/182
(58) Field of Search ..... 200/182, 187–189, 200/209–219, 233–236; 310/328, 331, 348, 363; 335/4, 47, 78; 385/19

(56) References Cited

U.S. PATENT DOCUMENTS

| | | | | |
|---|---|---|---|---|
| 2,312,672 A | | 3/1943 | Pollard, Jr. | |
| 2,564,081 A | | 8/1951 | Schilling | |
| 3,430,020 A | | 2/1969 | Von Tomkewitsch et al. | |
| 3,529,268 A | | 9/1970 | Rauterberg | |
| 3,600,537 A | | 8/1971 | Twyford | |
| 3,639,165 A | | 2/1972 | Rairden, III | |
| 3,657,647 A | | 4/1972 | Beusman et al. | |
| 3,955,059 A | * | 5/1976 | Graf | 200/181 |
| 4,103,135 A | | 7/1978 | Gomez et al. | |
| 4,200,779 A | | 4/1980 | Zakurdaev et al. | |
| 4,238,748 A | | 12/1980 | Goullin et al. | |
| 4,245,886 A | | 1/1981 | Kolodzey et al. | |
| 4,336,570 A | | 6/1982 | Brower | |
| 4,419,650 A | | 12/1983 | John | |
| 4,434,337 A | | 2/1984 | Becker | |
| 4,475,033 A | | 10/1984 | Willemsen et al. | |
| 4,505,539 A | | 3/1985 | Auracher et al. | |
| 4,582,391 A | | 4/1986 | Legrand | |
| 4,628,161 A | | 12/1986 | Thackrey | |
| 4,652,710 A | | 3/1987 | Karnowsky et al. | |

(List continued on next page.)

FOREIGN PATENT DOCUMENTS

| | | |
|---|---|---|
| EP | 0593836 A1 | 4/1994 |
| FR | 2418539 | 9/1979 |
| FR | 2458138 | 12/1980 |
| FR | 2667396 | 4/1992 |
| JP | 36-18575 | 10/1961 |
| JP | SHO47-21645 | 10/1972 |
| JP | 62-276838 | 12/1987 |
| JP | 63-294317 | 12/1988 |
| JP | 8-125487 | 5/1996 |
| JP | 9-161640 | 6/1997 |
| WO | WO99-46624 | 9/1999 |

OTHER PUBLICATIONS

Kim, Joonwon, et al., "A Micromechanical Switch With Electrostatically Driven Liquid–Metal Droplet", Sensors and Actuators, A: Physical v 9798, Apr. 1, 2002, 4 pages.

TDB–ACC–No.: NB8406827, "Integral Power Resistors For Aluminum Substrate", IBM Technical Disclosure Bulletin, Jun. 1984, US, vol. 27, Issue No. 1B, p. 827.

Bhedwar, Homi C., et al., "Ceramic Multilayer Package Fabrication", Electronic Materials Handbook, Nov. 1989, pp 460–469, vol. 1 Packaging, Section 4: Packages.

Simon, Jonathan, et al., "A Liquid–Filled Microrelay With a Moving Mercury Microdrop", Journal of Microelectromechanical Systems, Sep. 1997, pp 208–216, vol. 6, No. 3.

*Primary Examiner*—Michael A. Friedhofer
(74) *Attorney, Agent, or Firm*—Cynthia S. Mitchell

(57) ABSTRACT

Fluid-based switch and methods for reducing oxides and corrosion products within the switch are disclosed. In one method, oxides are reduced by depositing a gettering agent within the cavity, depositing a switching fluid on a first substrate, and mating the first substrate to a second substrate, the first substrate and the second substrate defining therebetween a cavity holding the switching fluid, the cavity being sized to allow movement of the switching fluid between first and second states.

16 Claims, 4 Drawing Sheets

U.S. PATENT DOCUMENTS 4,657,339 A 4/1987 Fick
4,742,263 A 5/1988 Harnden, Jr. et al.
4,786,130 A 11/1988 Georgiou et al.
4,797,519 A 1/1989 Elenbaas
4,804,932 A 2/1989 Akanuma et al.
4,988,157 A 1/1991 Jackel et al.
5,278,012 A 1/1994 Yamanaka et al.
5,415,026 A 5/1995 Ford
5,502,781 A 3/1996 Li et al.
5,644,676 A 7/1997 Blomberg et al.
5,675,310 A 10/1997 Wojnarowski et al.
5,677,823 A 10/1997 Smith
5,751,074 A 5/1998 Prior et al.
5,751,552 A 5/1998 Scanlan et al.
5,828,799 A 10/1998 Donald
5,841,686 A 11/1998 Chu et al.
5,849,623 A 12/1998 Wojnarowski et al.
5,874,770 A 2/1999 Saia et al.
5,875,531 A 3/1999 Nellissen et al.
5,886,407 A 3/1999 Polese et al.
5,889,325 A 3/1999 Uchida et al.
5,912,606 A 6/1999 Nathanson et al.
5,915,050 A 6/1999 Russell et al.
5,972,737 A 10/1999 Polese et al.
5,994,750 A 11/1999 Yagi
6,021,048 A 2/2000 Smith
6,180,873 B1 1/2001 Bitko
6,201,682 B1 3/2001 Mooij et al.
6,207,234 B1 3/2001 Jiang
6,212,308 B1 4/2001 Donald
6,225,133 B1 5/2001 Yamamichi et al.
6,278,541 B1 8/2001 Baker
6,304,450 B1 10/2001 Dibene, II et al.
6,320,994 B1 11/2001 Donald et al.
6,323,447 B1 11/2001 Kondoh et al.
6,351,579 B1 2/2002 Early et al.
6,356,679 B1 3/2002 Kapany
6,373,356 B1 4/2002 Gutierrez et al.
6,396,012 B1 5/2002 Bloomfield
6,396,371 B2 5/2002 Streeter et al.
6,408,112 B1 6/2002 Bartels
6,446,317 B1 9/2002 Figueroa et al.
6,453,086 B1 9/2002 Tarazona
6,470,106 B2 10/2002 McClelland et al.
6,487,333 B2 11/2002 Fouquet et al.
6,501,354 B1 12/2002 Gutierrez et al.
6,512,322 B1 1/2003 Fong et al.
6,515,404 B1 2/2003 Wong
6,516,504 B2 2/2003 Schaper
6,559,420 B1 5/2003 Zarev
6,633,213 B1 10/2003 Dove
6,646,527 B1 * 11/2003 Dove et al. ..... 335/47
6,647,165 B2 * 11/2003 Hu et al. ..... 385/16
2002/0037128 A1 3/2002 Burger et al.
2002/0146197 A1 10/2002 Yong
2002/0150323 A1 10/2002 Nishida et al.
2002/0168133 A1 11/2002 Saito
2003/0035611 A1 2/2003 Shi

* cited by examiner

GETTERING AGENT AND METHOD TO PREVENT CORROSION IN A FLUID SWITCH

BACKGROUND OF THE INVENTION

Liquid metal micro switches (LIMMS) have been made that use a liquid metal, such as mercury, gallium-bearing alloys or other liquid metal composites, as the switching fluid. The liquid metal may make, break or latch electrical contacts. To change the state of the switch, a force is applied to the switching fluid, which causes it to change form and move. Liquid metal switches rely on the cleanness of the liquid metal for good performance. If the liquid metal forms oxide films or other types of corrosion product buildup within the switch, the proper functioning or performance of the switch may degrade or be inhibited.

For example, the oxide film or other corrosion products may increase the surface tension of the liquid metal, which may increase the energy required for the switch to change state over time. Films of oxide and other corrosion product may increase the tendency for the liquid metal to wet to the substrate between switch contacts, thereby increasing undesirable short circuits in the switching operation. Build up of oxide and other corrosion product may also degrade the ability of the liquid metal to wet to the switch contacts, and thereby may increase the probability of undesirable open circuits in the switching operation.

The build up of oxide and other corrosion products within the liquid metal switch may also alter the effective surface tension of the liquid metal with itself, causing the liquid metal to become stringy when moved or stretched, and thereby decreasing the tendency of the liquid metal to break cleanly between switch contacts and potentially causing short circuits and increasing the energy requirement for the switch to change state.

These issues are especially problematic for switches that are physically small, as the actuator size and strength is proportionally decreased and the surface tension forces become relatively large. This is true particularly for switches that are actuated by changes in internal pressure, but also for switches that are actuated in other ways. It is desirable to have liquid metal that is as free of corrosion products as practically possible in order to minimize these effects. Keeping other surfaces within a switch free of corrosion products is also important for good functioning, such as the switch contacts and metallic sealing surfaces to which the liquid metal wets.

It is desirable to have liquid metal that is as free of oxide and other corrosion products as practically possible in order to minimize the abovementioned negative effects. There is a need for a method to decrease or eliminate the build up of oxide or other corrosion products in liquid metal switches.

SUMMARY OF THE INVENTION

In one embodiment, a method for reducing oxides and other corrosion products on a switching fluid is disclosed. The method includes depositing a switching fluid on a first substrate. The first substrate is mated to a second substrate, the first substrate and the second substrate defining therebetween a cavity holding the switching fluid. The cavity is sized to allow movement of the switching fluid between first and second states. A gettering agent is deposited in the cavity and may prevent oxide and corrosion products from forming by reacting with free oxygen, water vapor, and other corrosive gases in the cavity.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION

Figure 1:
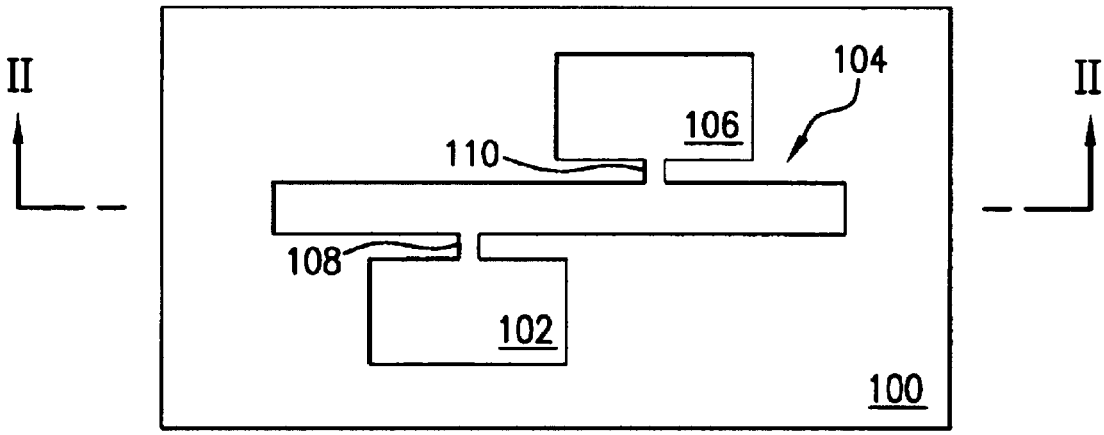
FIG. 1 illustrates a plan view of a first exemplary embodiment of a fluid-based switch.
Figure 2:
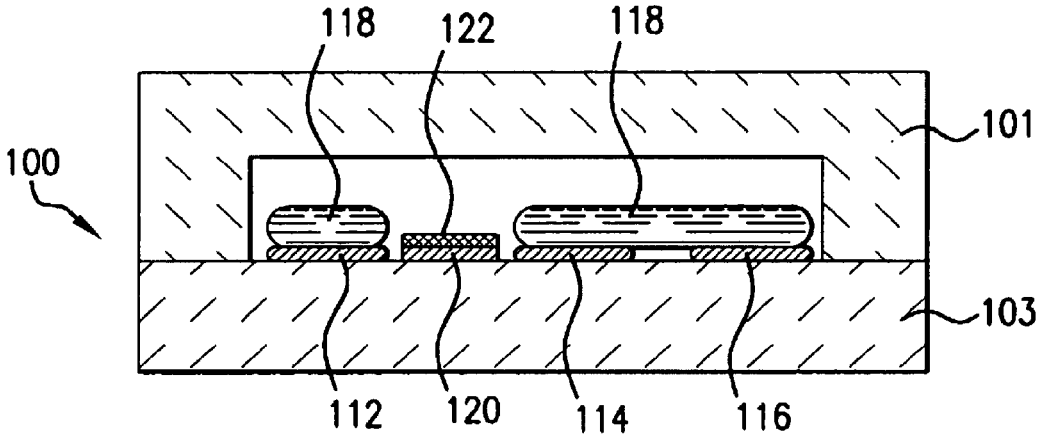
FIG. 2 illustrates an elevation of the switch shown in FIG. 1.

FIGS. 1 and 2 illustrate a fluid-based switch such as a LIMMS. The switch 100 includes a switching fluid cavity 104, a pair of actuating fluid cavities 102, 106, and a pair of cavities 108, 110 that connect corresponding ones of the actuating fluid cavities 102, 106 to the switching fluid cavity 104. It is envisioned that more or fewer channels may be formed in the switch. For example, the pair of actuating fluid cavities 102, 106 and pair of connecting cavities 108, 110 may be replaced by a single actuating fluid cavity and single connecting cavity.

Figure 3:
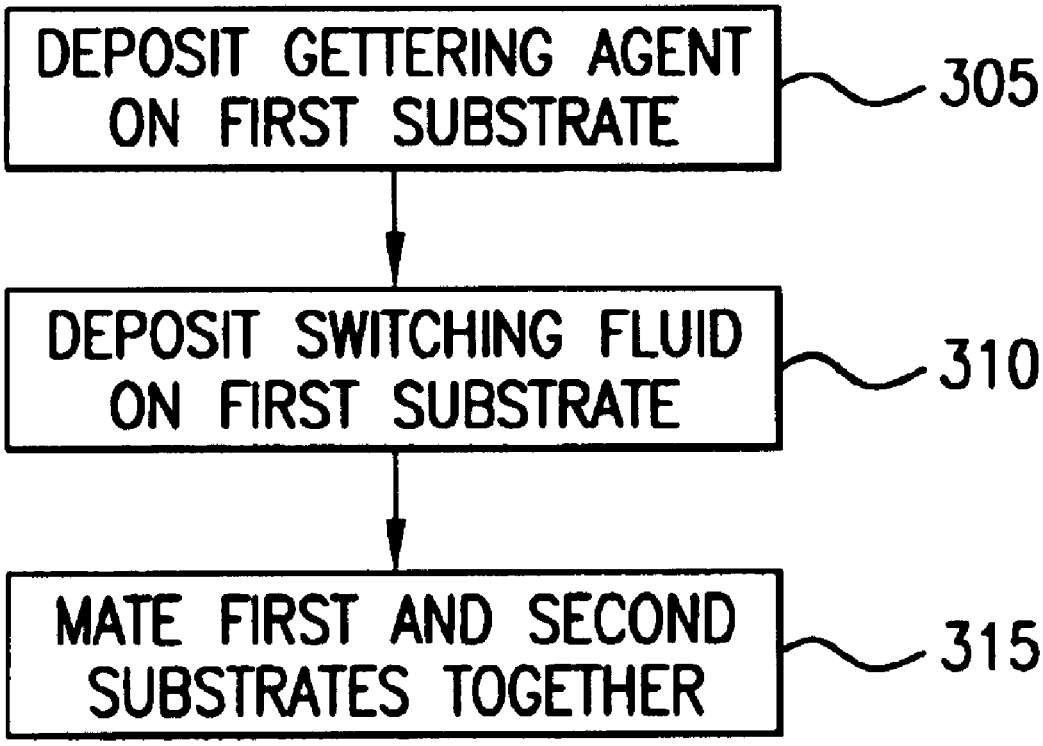
FIG. 3 illustrates an exemplary method that may be used to produce the fluid-based switch of FIGS. 1 and 2; (actually the steps should be to (305) deposit the gettering agent, (310) deposit switching fluid on first substrate, and (315) mate substrates together.

As illustrated by FIG. 3, the switch 100 may be produced by 305 depositing a gettering agent 122 in the cavity holding the switching fluid 118. The gettering agent 122 may be a chemical gettering agent selected to prevent corrosion products from forming within the cavity by reacting with free oxygen, water vapor and other corrosive gases. For example, if the liquid metal switching fluid 118 is mercury, it is possible to use an aluminum gettering agent packed inside the cavity, so that the aluminum will react with the corrosive gases to form nonvolatile aluminum salts, such as oxides or fluorides. Other gettering agents are anticipated, such as, magnesium or titanium. The aluminum may be deposited 305 on a heater 120 so it can be heated after assembly to increase the reaction rate with the corrosive gases and do a better job of neutralizing their effects on the switches performance. The gettering agent 122 may be heated periodically or continuously during operation to enhance the gettering action.

A switching fluid 118 is deposited 310 on a plurality of contacts 112–116 on a first substrate 103. In one embodiment, the switching fluid may be a liquid metal, such as mercury or alloys that contain gallium. As will be described in further detail below, the switching fluid 118 may be used to make and break contact between the contacts 112, 114, 116. In an alternate embodiment, the switching fluid may be deposited on a plurality of wettable pads and may be used to open and block light paths. Although the switch illustrated in FIG. 1 includes three contacts, it should be appreciated that alternate embodiments may have a different number of contacts. The cavity is sized to allow movement of the switching fluid 118 between first and second states.

Next, the first substrate 103 is mated 315 to a second substrate 101 so that a cavity holding the switching fluid 118 is defined between the two substrates. The mating step may be accomplished by any known means, such as lamination using adhesives or wafer to wafer bonding using the Ziptronics assembly method. It will be appreciated that these steps may be done in a different order, for example, the switching fluid may be deposited before the gettering agent. There are also different methods of manufacturing a switch that are also contemplated within this invention.

Figure 4:
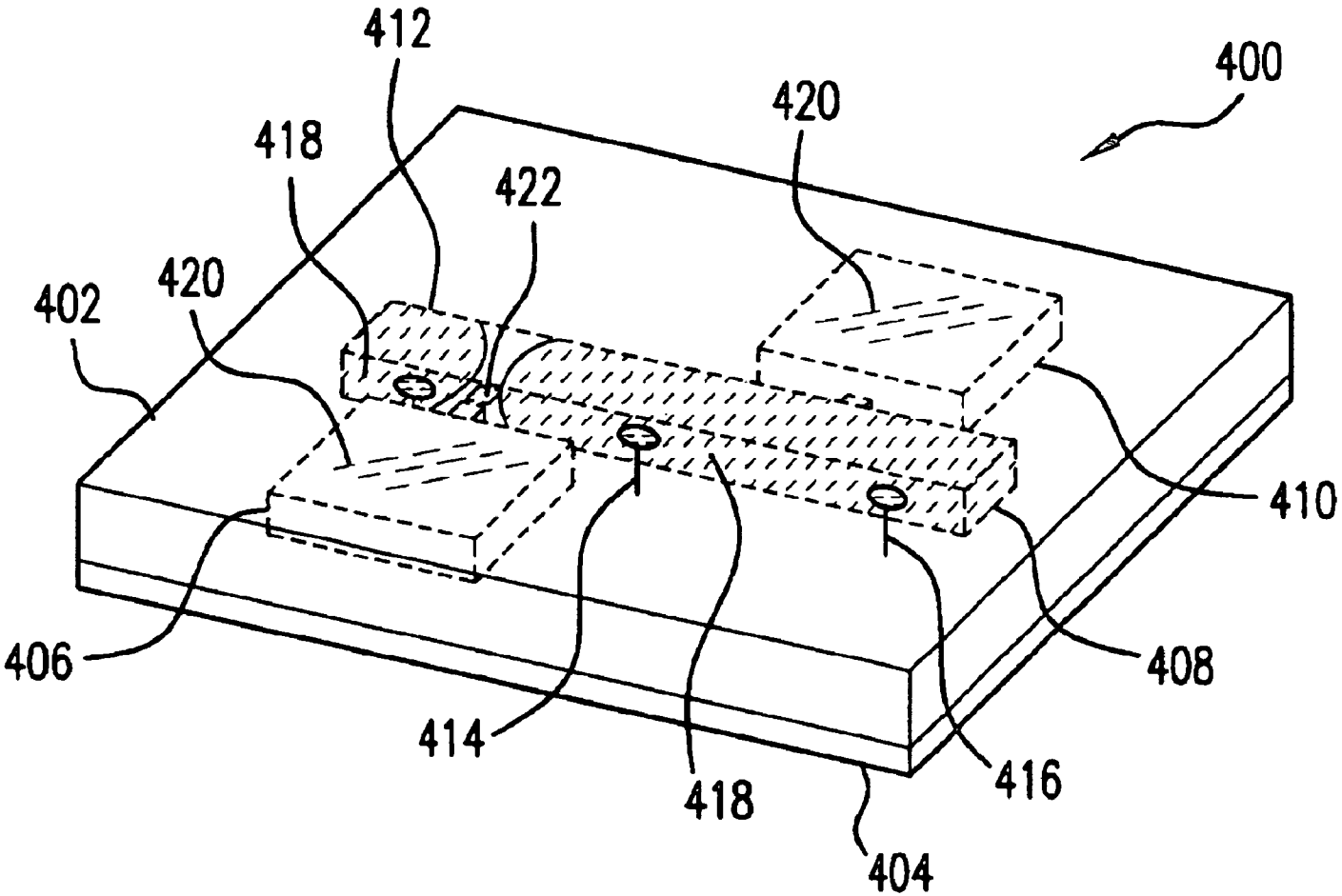
FIG. 4 illustrates a perspective view of an exemplary embodiment of a switch including an oxide or corrosion inhibitor in a fluid based switch.

The functioning of a switch according to one embodiment can be explained with reference to FIG. 4. The switch 400 comprises a first substrate 402 and a second substrate 404 mated together. The substrates 402 and 404 define between them a number of cavities 406, 408, and 410. Exposed within one or more of the cavities are a plurality of electrodes 412, 414, 416. A switching fluid 418 (e.g., a conductive liquid metal such as mercury) held within one or more of the cavities serves to open and close at least a pair of the plurality of electrodes 412–416 in response to forces that are applied to the switching fluid 418. An actuating fluid 420 (e.g., an inert gas or liquid) held within one or more of the cavities serves to apply the forces to the switching fluid 418.

In one embodiment of the switch 400, the forces applied to the switching fluid 418 result from pressure changes in the actuating fluid 420. The pressure changes in the actuating fluid 420 impart pressure changes to the switching fluid 418, and thereby cause the switching fluid 418 to change form, move, part, etc. In FIG. 4, the pressure of the actuating fluid 420 held in cavity 406 applies a force to part the switching fluid 418 as illustrated. In this state, the rightmost pair of electrodes 414, 416 of the switch 400 are coupled to one another. If the pressure of the actuating fluid 420 held in cavity 406 is relieved, and the pressure of the actuating fluid 420 held in cavity 410 is increased, the switching fluid 418 can be forced to part and merge so that electrodes 414 and 416 are decoupled and electrodes 412 and 414 are coupled.

By way of example, pressure changes in the actuating fluid 420 may be achieved by means of heating the actuating fluid 420, or by means of piezoelectric pumping. The former is described in U.S. pat. No. 6,323,447 of Kondoh et al. entitled "Electrical Contact Breaker Switch, Integrated Electrical Contact Breaker Switch, and Electrical Contact Switching Method", which is hereby incorporated by reference for all that it discloses. The latter is described in U.S. patent application Ser. No. 10/137,691 of Marvin Glenn Wong filed May 2, 2002 and entitled "A piezoelectrically Actuated Liquid Metal Switch", which is also incorporated by reference for all that it discloses. Although the above referenced patent and patent application disclose the movement of a switching fluid by means of dual push/pull actuating fluid cavities, a single push/pull actuating fluid cavity might suffice if significant enough push/pull pressure changes could be imparted to a switching fluid from such a cavity. Additional details concerning the construction and operation of a switch such as that which is illustrated in FIG. 4 may be found in the afore-mentioned patent of Kondoh.

Switch 400 further includes gettering agent 422 within the cavity 408. The gettering agent 422 may comprise aluminum or magnesium, or titanium and may be deposited on a heater element. Gettering agent 422 may help prevent corrosion products from forming in the cavity 408 by reacting with free oxygen, water vapor and other corrosive gases to form nonvolatile aluminum oxide, magnesium oxide, titanium dioxide, or salts of aluminum, magnesium, titanium and the corrosive gases, e.g. aluminum chloride from aluminum and chlorine.

A second exemplary embodiment of the functioning of a switch 500 will now be described with reference to FIG. 5. The switch 500 comprises a substrate 502 and a second substrate 504 mated together. The substrates 502 and 504 define between them a number of cavities 506, 508, 510. Exposed within one or more of the cavities are a plurality of wettable pads 512–516. A switching fluid 518 (e.g., a liquid metal such as mercury) is wettable to the pads 512–516 and is held within one or more of the cavities. The switching fluid 518 serves to open and block light paths 522/524, 526/528 through one or more of the cavities, in response to forces that are applied to the switching fluid 518.

By way of example, the light paths may be defined by waveguides 522–528 that are aligned with translucent windows in the cavity 508 holding the switching fluid. Blocking of the light paths 522/524, 526/528 may be achieved by virtue of the switching fluid 518 being opaque. An actuating fluid 520 (e.g., an inert gas or liquid) held within one or more of the cavities serves to apply the forces to the switching fluid 518.

Switch 500 may additionally include gettering agent 522 deposited in cavity 508. Gettering agent 522 may be deposited on a heater to enable the gettering agent 522 to react with free oxygen, water vapor and other corrosive gases to form nonvolatile aluminum oxide, magnesium oxide, titanium dioxide, or salts of aluminum, magnesium, titanium and the corrosive gases, e.g. aluminum chloride from aluminum and chlorine. The gettering agent 522 should be situated in the cavity 508 or on the heaters in 506 and 510 so as not to interfere with the light paths 522/524, 526/528 or the switching of the liquid fluid.

Figure 5:
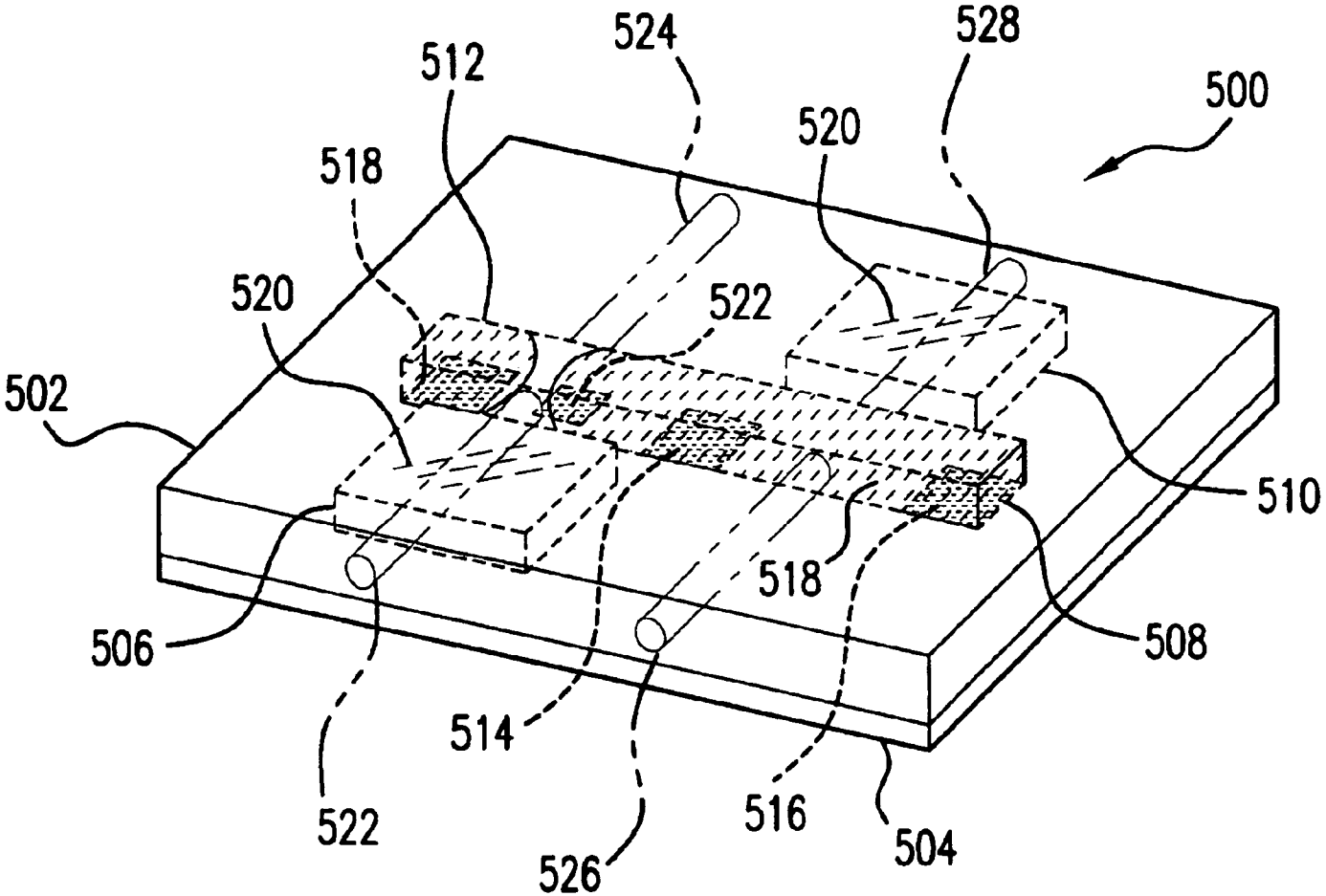
FIG. 5 illustrates a perspective view of another exemplary embodiment of a switch including an oxide or corrosion inhibitor in a fluid based switch.

Additional details concerning the construction and operation of a switch such as that which is illustrated in FIG. 5 may be found in the aforementioned patent of Kondoh et al., and patent application of Marvin Wong.

While illustrative and presently preferred embodiments of the invention have been described in detail herein, it is to be understood that the inventive concepts may be otherwise variously embodied and employed. For example, more than one gettering agent may deposited at different locations within the cavity or cavities of the fluid switch. The appended claims are intended to be construed to include such variations, except as limited by the prior art.

What is claimed is:

1. A method, comprising:

depositing a switching fluid with a surface area on a first substrate;

depositing a gettering agent on the first substrate; and mating the first substrate to a second substrate, the first substrate and the second substrate defining therebetween a cavity holding the switching fluid, the cavity being sized to allow movement of the switching fluid between first and second states.

2. The method of claim 1, wherein the gettering agent comprises a heater.

3. The method of claim 1, wherein the switching fluid comprises mercury.

4. The method of claim 3, wherein the gettering agent comprises aluminum, magnesium or titanium.

5. The switch of claim 1, wherein the switch is a liquid metal switch.

6. The switch of claim 1, wherein the switching fluid comprises mercury.

7. The switch of claim 6, wherein the gettering agent comprises aluminum, magnesium or titanium.

8. The switch of claim 7, wherein the gettering agent comprises a heater.

9. A switch comprising:

first and second mated substrates defining therebetween at, least portions of a number of cavities;

a plurality of electrodes exposed within one or more of the cavities;

a switching fluid, held within a first one of the cavities, that serves to open and close at least a pair of the plurality of electrodes in response to forces that are applied to the switching fluid;

a gettering agent exposed within one or more of the cavities;

an actuating fluid, held within one or more of the cavities, that applies the forces to said switching fluid.

10. The switch of claim 9, wherein the gettering agent may be activated with a heater.

11. The switch of claim 9, wherein the switching fluid comprises mercury.

12. The switch of claim 11, wherein the gettering agent comprises aluminum, magnesium or titanium.

13. A switch comprising:

first and second mated substrates defining therebetween at least portions of a number of cavities;

a plurality of wettable pads exposed within one or more of the cavities;

a switching fluid, wettable to said pads and held within one or more of the cavities, that serves to open and block light paths through one or more of the cavities in response to forces that are applied to the switching fluid;

a gettering agent deposited within one or more of the cavities; and an actuating fluid, held within one or more of the cavities, that applies the forces to said switching fluid.

14. The switch according to claim 13, wherein a heater activates the gettering agent.

15. The switch according to claim 14, wherein the switching fluid comprises mercury.

16. The switch according to claim 15, wherein the gettering agent comprises aluminum, magnesium or titanium.

* * * * *